US006725627B2

(12) United States Patent
Weder et al.

(10) Patent No.: US 6,725,627 B2
(45) **Date of Patent: *Apr. 27, 2004**

(54) METHOD OF SHIPPING PREFORMED FLOWER POT COVERS

(75) Inventors: Donald E. Weder, Highland, IL (US); William F. Straeter, Breese, IL (US); Philip G. Hereford, Highland, IL (US); P. J. Vermeer, Grimsby (CA)

(73) Assignee: Southpac Trust Int'l., Inc., Highland, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/370,797

(22) Filed: Feb. 20, 2003

(65) Prior Publication Data

US 2003/0121234 A1 Jul. 3, 2003

Related U.S. Application Data

(63) Continuation of application No. 09/999,271, filed on Nov. 15, 2001, which is a continuation of application No. 09/455,191, filed on Dec. 6, 1999, now abandoned, which is a continuation of application No. 09/178,451, filed on Oct. 23, 1998, now Pat. No. 6,122,896.

(51) Int. Cl.[7] ..... B65B 13/02

(52) U.S. Cl. ..... 53/399; 53/447; 53/445; 414/788.2

(58) Field of Search ..... 53/397, 399, 445, 53/447, 472, 540, 580, 581, 139.5, 142, 156; 414/788.2; 206/386, 423, 493, 499, 585

(56) References Cited

U.S. PATENT DOCUMENTS 1,280,692 A 10/1918 Errett
1,398,030 A 11/1921 Luellen
3,759,303 A 9/1973 Honrichs et al.
3,804,234 A 4/1974 Gordon
4,033,455 A 7/1977 Robison
4,170,294 A 10/1979 Zelinski
4,227,362 A 10/1980 Wallsten
5,092,464 A 3/1992 Taylor et al.
5,195,296 A 3/1993 Matsumoto
5,203,531 A 4/1993 Gracon
5,472,752 A 12/1995 Weder et al.
5,551,563 A 9/1996 Allen
5,634,555 A 6/1997 Dunham
5,797,246 A 8/1998 Martin-Cocher et al.
6,032,801 A 3/2000 Jupille et al.
6,122,896 A 9/2000 Weder et al.
6,152,305 A 11/2000 Green

*Primary Examiner*—Eugene Kim
(74) *Attorney, Agent, or Firm*—Dunlap Codding & Rogers

(57) ABSTRACT

A method of shipping a plurality of preformed flower pot covers is provided. Each preformed flower pot cover includes a sheet of material formed into a shape sized to receive a flower pot. The preformed flower pot cover has a base with a closed lower end and an open upper end with an object opening extending therethrough for receiving the flower pot. The method includes providing a portable platform having a plurality of stacking shells disposed therefrom. Each stacking shell is configured to be received in the object opening of one of the preformed flower pot covers. A stack of preformed flower pot covers is formed on each of the stacking shells such that the preformed flower pot covers of the stack are nested within one another and supported on the stacking shell and secured to the portable platform. The platform with the preformed flower pot covers is then transported to a predetermined destination.

14 Claims, 7 Drawing Sheets

METHOD OF SHIPPING PREFORMED FLOWER POT COVERS

CROSS-REFERENCE TO RELATED APPLICATIONS

This application is a continuation of U.S. Ser. No. 09/999,271, filed Nov. 15, 2001, which is a continuation of U.S. Ser. No. 09/455,191, filed Dec. 6, 1999, now abandoned, which is a continuation of U.S. Ser. No. 09/178,451, filed Oct. 23, 1998, now U.S. Pat. No. 6,122,896.

STATEMENT REGARDING FEDERALLY SPONSORED RESEARCH OR DEVELOPMENT

Not applicable.

BACKGROUND OF THE INVENTION

1. Field of the Invention

The present invention relates generally to the shipping of articles on pallets, and more particularly, but not by way of limitation, to an improved method of packaging and transporting preformed flower pot covers.

2. Brief Description of the Related Art

Decorative covers for flower pots have been used for many years to accentuate or complement the aesthetic appearance of a floral grouping disposed in the flower pot. Such decorative covers are often preformed flower pot covers made by forming a flexible sheet of material into a shape adapted to receive the flower pot.

In the process of forming the sheet of material into the flower pot cover, a plurality of overlapping folds are formed in the material. The overlapping folds cooperate to provide structural strength to keep the preformed shape of the flower pot cover. In addition, flower pot covers are often formed to have a skirt portion which is designed to extend beyond the upper end of the flower pot and functions to cover the soil and the lower portion or stem portion of a floral grouping which can be unattractive and thus draw away from the attractiveness of the combination of the blooms of the floral grouping and the flower pot cover.

To ship flower pot covers after the forming process, a plurality of the preformed flower pot covers are typically stacked or nested relative to one another and the stack is placed in a cardboard box. After several stacks of the preformed flower pot covers have been placed in the box, the box is closed and sealed.

While the use of cardboard boxes have been widely accepted in the packaging and shipping of preformed flower pot covers, they are not without disadvantages. For example, cardboard boxes represent a disposal problem for the receiver of the flower pot covers. In addition, the contents of the box can not be inspected without unsealing and opening the box. As such, one is unable to observe the quality and quantity of the flower pot covers prior to opening the box.

To this end, a method of packaging preformed flower pot covers is needed that permits easy transport of a large quantity of flower pot covers while overcoming the disadvantages mentioned above. It is to such a method that the present invention is directed.

BRIEF SUMMARY OF THE INVENTION

The present invention is directed to a method of shipping a plurality of preformed flower pot covers is provided. Each preformed flower pot cover includes a sheet of material formed into a shape sized to receive a flower pot. The preformed sheet of material has a base with a closed lower end and an open upper end with an object opening extending therethrough for receiving the flower pot. The method includes providing a portable platform having a plurality of stacking shells extending therefrom. Each stacking shell is configured to be received in the object opening of one of the preformed flower pot covers. A stack of preformed flower pot covers is stacked on at least a portion of the stacking shells such that the preformed flower pot covers of the stack are nested within one another and supported by the stacking shell and secured to the portable platform. The platform with the preformed flower pot covers is then transported to a predetermined destination.

The objects, features and advantages of the present invention will become apparent from the following detailed description when read in conjunction with the accompanying drawings and appended claims.

DETAILED DESCRIPTION OF THE INVENTION

Figure 1:
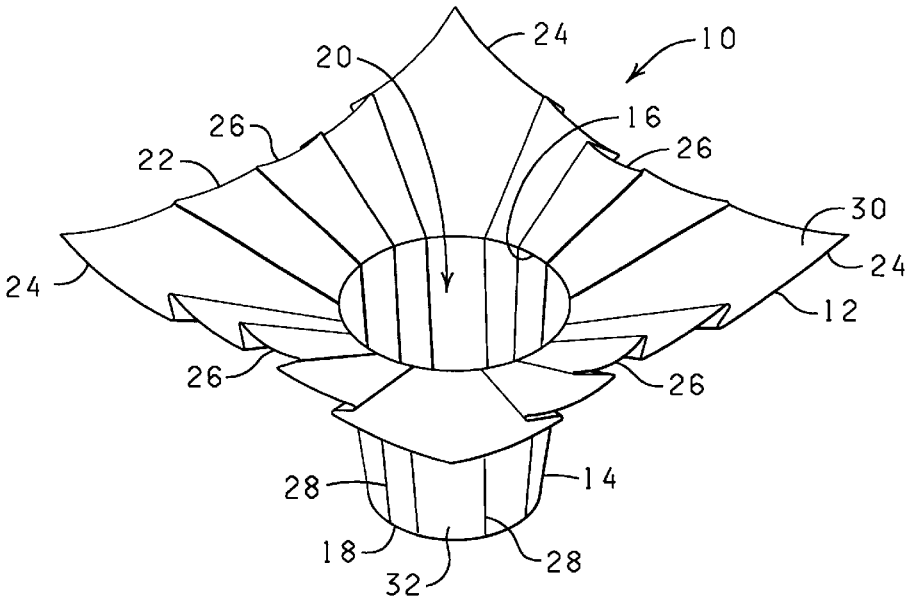
FIG. 1 PRIOR ART
FIG. 1 is a perspective view of a prior art preformed flower pot cover.

Referring now to the drawings, and more specifically to FIG. 1, the present invention is generally directed to a method for packaging a plurality of flower pot covers which are preformed to have a predetermined shape from a flexible sheet of material. The sheet of material used to form the flower pot covers is typically fabricated from a polymeric material selected from a group consisting of polypropylene, polyvinyl chloride, or combinations thereof. However, it will be appreciated that the sheet of material can be fabricated of paper, metal foil, cloth, denim, or burlap, for example. The sheet of material contemplated to be used with the present invention is also relatively thin having a thickness in a range from about 0.5 mils to about 30 mils, and the sheet of material is very flexible and flimsy so that the sheet of material will not normally maintain or hold a predetermined formed shape (non-shape sustaining).

An example of a preformed flower pot cover that is contemplated to be packaged using the method of the present invention is illustrated in FIG. 1. More particularly, FIG. 1 illustrates a flower pot cover 10 preferably, although not exclusively, formed from a generally square-shaped sheet of material 12. The flower pot cover 10 includes a base 14 having an opened upper end 16, a closed lower end 18, an object opening 20 extending through the upper end 16, and a decorative skirt 22 which extends angularly upwardly and outwardly from the upper end 16 of the base 14. The decorative skirt 22 includes four accentuated and sculptured flared petal-like portions 24. Each flared petal-like portion 24 terminates with a pointed end which is formed by one of the four corners of the square-shaped sheet of material 12. Further, each flared petal-like portion 24 extends a distance angularly upwardly and outwardly from the upper end 16 of the base 14 terminating with the pointed end of the flared petal-like portion 24. The flared petal-like portions 24 are spaced apart circumferentially about the decorative skirt 22 with the flared petal-like portions 24 being spaced apart at about ninety degree intervals, and a flare connecting portion 26 disposed between each pair of adjacent flared petal-like portions 24. Each of the flare connecting portions 26 extends a distance angularly upwardly and outwardly from the upper end 16 of the base 14 less than the distances which the pointed ends of the flared petal-like portions 24 extend from the upper end 16 of the base 14.

The object opening 20 of the flower pot cover 10 is shaped and sized to receive a flower pot (not shown). When a flower pot is disposed in the object opening 20 of the flower pot cover 10, the base 14 substantially encompasses the outer peripheral surface of the flower pot extending generally between the upper and the lower ends of the flower pot with the upper end 16 of the base 14 being disposed generally near the upper end of the flower pot and the lower end 18 of the flower pot cover 10 being disposed generally near the lower end of the flower pot. The closed lower end 18 of the flower pot cover 10 extends across and encompasses the lower end of the flower pot. When the flower pot cover 10 is disposed about the flower pot, the decorative skirt 22 of the flower pot cover 10 extends a distance angularly upwardly and outwardly from the upper end of the flower pot and the flower pot cover 10 extends generally circumferentially about the upper end of the flower pot.

The base 14 of the flower pot cover 10 includes a plurality of overlapping folds 28 (only some of the overlapping folds 28 being designated by a reference numeral in the drawings). A substantial portion of the overlapping folds 28 extend at angles to a vertical direction and at angles to a horizontal direction, the various angles being arbitrary and varying from one overlapping fold 28 to another overlapping fold 28. Further, the base 14 includes a plurality of overlapping folds 28 with the various overlapping folds 28 being positioned at various positions about the entire outer peripheral surface of the base 14 and at various positions between the upper and the lower ends 16 and 18 of the base 14. The overlapping folds 28 provide an overall decorative appearance to the base 14. However, more significantly, the overlapping folds 28 provide a mechanical strength to the base 14 for enabling the base 14 to stand upright (substantially retain the shape formed by the apparatus of the present invention described below) on the closed lower end 18 of the base 14. In this manner, the base 14 of the flower pot cover 10 has sufficient mechanical strength to stand upright about a flower pot without the necessity of mechanically connecting the base 14 to a flower pot, other than the connection normally provided when the lower end of a flower pot engages the lower end 18 of the flower pot cover 10 when the flower pot cover 10 is disposed about a flower pot.

The sheet of material 12 has an upper surface 30 and a lower surface 32, and either the upper surface 30 or the lower surface 32 or both the upper surface 30 and the lower surface 32 is adapted to be bondable so that when portions of the bondable surface are brought into bondable contact, such portions are bondably connected. The overlapping folds 28 are formed by overlapping portions of the bondable surface and bringing such overlapping portions into bondable engagement or contact. In this manner, the overlapping folds 28 are permanently fixed in the flower pot cover 10. When an overlapping fold 28 is formed with a portion of the sheet of material 12 during the forming of the flower pot cover 10, portions of the upper surface 30 are overlapped and brought into bondable contact or engagement and, with respect to the same overlapping fold 28, portions of the lower surface 32 also are overlapped and brought into bondable contact or engagement.

As mentioned before, at least one of the upper and the lower surfaces 30 and 32 is prepared to form a bondable surface which is adapted to be bonded to portions of a similar bondable surface when bondably contacted with a similar bondable surface portion. Thus, in those instances when only the lower surface 32 is prepared to form a bondable lower surface 32, the overlapping portions of the bondable lower surface 32 are brought into bondable contact during the forming of the flower pot cover 10 and such overlapping portions are bonded to form the overlapping folds 28. The corresponding overlapping portions of the upper surface 30 are not bonded. Similarly, in those instances when only the upper surface 30 is prepared to form a bondable upper surface 30, the overlapping portions of the bondable upper surface 30 are brought into bondable contact during the forming of the flower pot cover 10 and such overlapping portions are bonded to form the overlapping folds 28. The corresponding overlapping portions of the lower surface 32 are not bonded. Finally, in those instances when both the upper and the lower surfaces 30 and 32 are prepared to form bondable upper and lower surfaces 30 and 32, the overlapping portions of the upper and the lower surfaces 30 and 32 forming each overlapping fold 28 are brought into bondable contact during the forming of the flower pot cover 10 and such overlapping portions of the upper and the lower surfaces 30 and 32 are bonded to form the overlapping folds 28.

For aesthetic purposes, it is preferable that the decorative skirt 22 and particularly the flared petal-like portions 24 remain substantially smooth and substantially free of bonded overlapping folds. Also, it is desirable that the flare connecting portions 26 also remain substantially smooth and substantially free of bonded overlapping folds.

Other examples of preformed flower pot covers are disclosed in U.S. Pat. No. 5,029,412, issued to Weder et al. on Jul. 9, 1991, and U.S. Pat. No. 5,254,072, issued to Weder et al. on Oct. 19, 1993, both of which are hereby expressly incorporated herein by reference.

Figure 2:
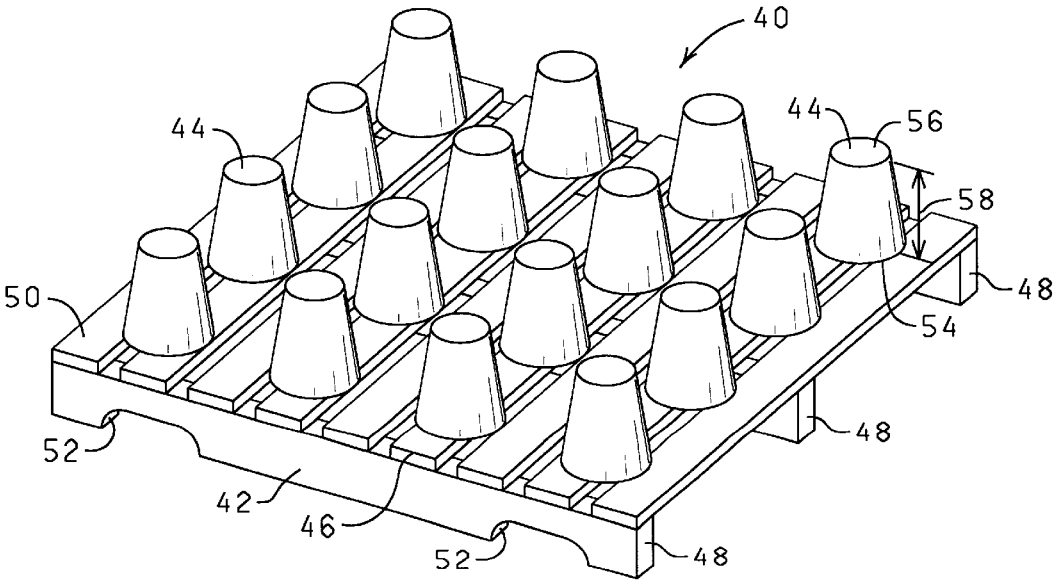
FIG. 2 is a perspective view of a shipping pallet for use in transporting a plurality of preformed flower pot covers.

Referring now to FIG. 2, a shipping pallet 40 constructed in accordance with the present invention is illustrated. The shipping pallet 40 provides a simple and low cost device for packaging and shipping a plurality of preformed flower pot covers, such as the flower pot cover 10 described above, in a convenient and cost effective manner.

The shipping pallet 40 comprises a portable platform 42 and a plurality of stacking shells 44 disposed thereon. The portable platform 42 is shown in FIG. 2 to be a conventional wooden platform constructed of a plurality of slats 46 connected to a plurality of feet or cross members 48 in a spaced apart, coplanar relationship so as to form an upper planar surface 50. The cross members 48 are arranged in a perpendicular relationship relative to the slats 46 and are provided with a pair of fork receiving slots 52 to facilitate movement of the shipping pallet 40 with a fork lift (not shown). While the platform 42 is illustrated as being constructed of wood, it will be appreciated that the platform 42 can be constructed of any other suitable material, such as plastic.

The stacking shells 44 are disposed on the platform 42 so as to extend upward from the upper planar surface 50 thereof. The stacking shells 44 are each configured to be received in the object opening 20 of one of the preformed flower pot covers 10 so that the preformed flower pot covers 10 may be stacked on the stacking shells 44 in an inverted position, as illustrated in FIGS. 3 and 4, without the adjacent stacks of flower pot covers interfering with another.

The stacking shells 44 may be constructed of any suitable material and configured in any desirable shape. However, a preferable material is a lightweight, durable plastic and a preferable shape is frusto-conical whereby the flower pot covers 10, which are typically formed to have a frusto-conical shape for receiving a frusto-conically shaped flower pot, substantially conform to the contour of the stacking shells 44. By way of example, each of the stacking shells 44 could alternatively be a flower pot or a round cardboard tube or styrofoam form having the necessary size and configuration to support a stack of flower pot covers.

As shown in FIG. 2, each of the stacking shells 44 has a bottom end 54, a top end 56, and a height 58 extending between the bottom end 54 and the top end 56. To provide more stability, the stacking shells 44 may be secured to the platform 42 in any suitable manner, such as with a nut and bolt (not shown).

Figure 3:
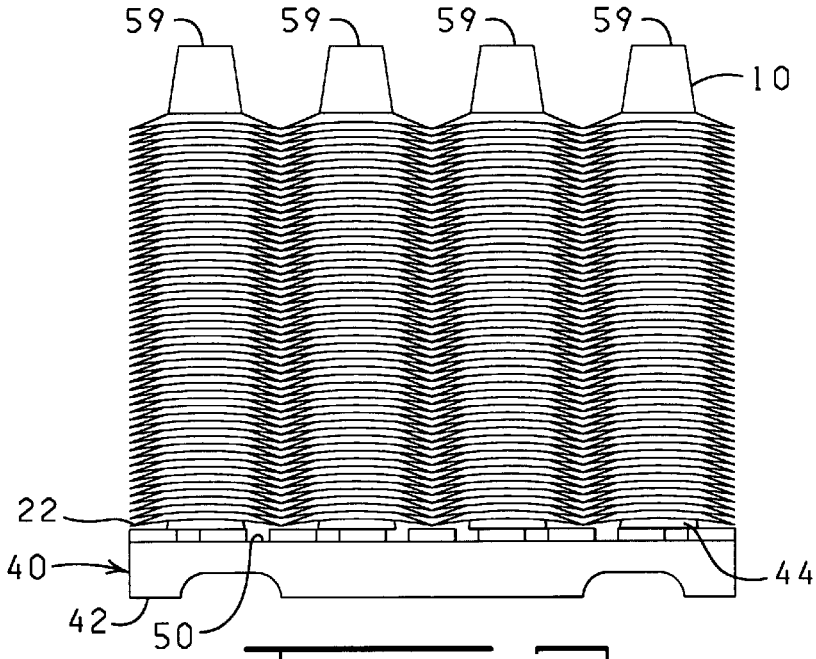
FIG. 3 is a side elevational view of the shipping pallet of FIG. 2 illustrated with a plurality of stacks of preformed flower pot covers supported thereon.
Figure 4:
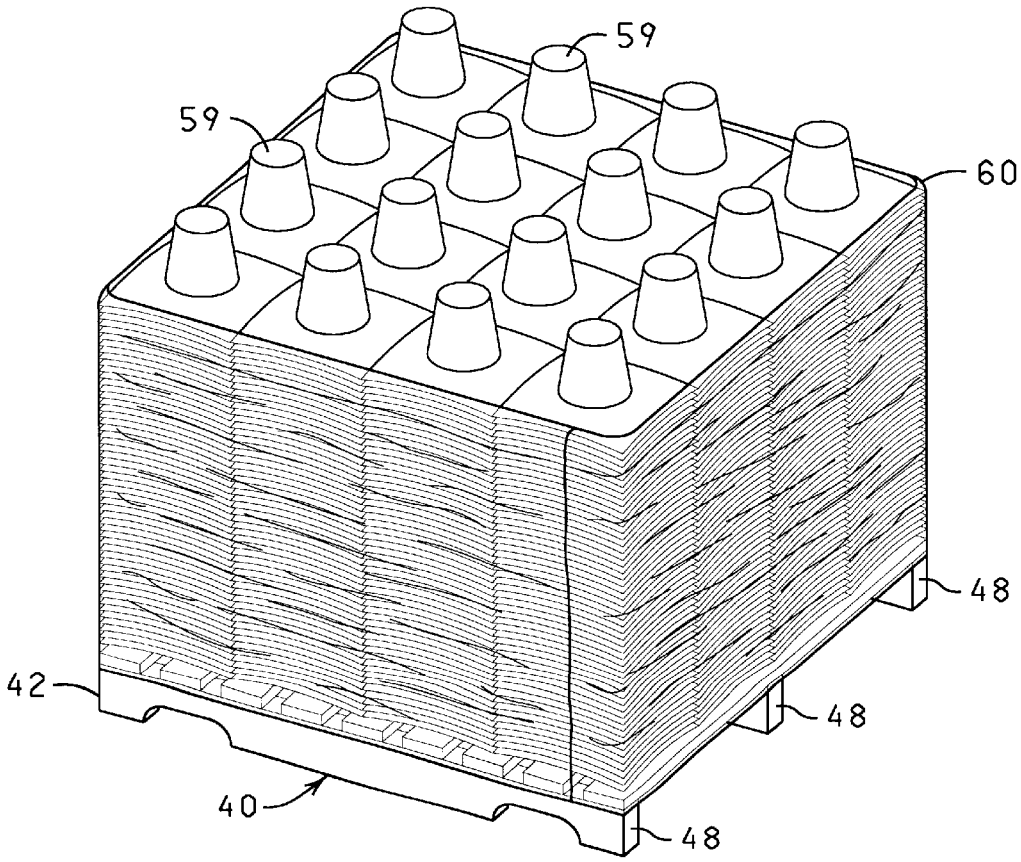
FIG. 4 is a perspective view of the shipping pallet of FIG. 3 showing the stacks of preformed flower pot covers secured to the shipping pallet by a transparent sheet of material.

As illustrated in FIG. 3, a plurality of flower pot covers 10 are stacked on the stacking shells 44 one on top of the other to form a plurality of stacks 59 of flower pot covers 10. The preformed flower pot covers 10 of the stacks 59 are nested within one another and supported on the stacking shells 44. To prevent the decorative skirt 22 of the bottommost flower pot cover 10 from being crushed or otherwise damaged due to contact with the upper planar surface 50 of the platform 42, the stacks 59 of preformed flower pot covers 10 are preferably supported on the stacking shells 44 in a non-load bearing relationship with respect to the platform 42. More particularly, each of the stacking shells 44 are constructed so that the height 58 of each of the stacking shells 44 is sufficient to support the stack 59 of flower pot covers 10 such that the decorative skirt 22 of the bottommost flower pot cover 10 is in a non-engaging relationship with respect to the upper planar surface 50 of the platform 42 or only the outermost points of the decorative skirt 22 of the bottommost flower pot cover 10 engages the upper planar surface 50 of the platform 42 so that the decorative skirt 22 remains in an outwardly flared condition.

The thinness of the material used to form the flower pot covers 10 and the nesting ability of the flower pot covers 10 permits a significant number of the flower pot covers to be positioned on one shipping pallet 40. For example, each of the stacks 59 of flower pot covers 10 may be formed to be as high as six or seven feet, thereby resulting in the positioning of as many as 16,000 six inch diameter flower pot covers on a 48 inch by 48 inch shipping pallet and 42,000 four inch diameter flower pot covers on a 40 inch by 48 inch shipping pallet. In comparison, using the conventional method of shipping flower pot covers in cardboard boxes, a 40 inch by 48 inch pallet will support 30 boxes dimensioned to hold 400 four inch diameter flower pot covers each. This constitutes only 12,000 flower pot covers on one pallet versus 42,000 flower pot covers using the method of the present invention.

To secure the stacks of flower pot covers 10 to the pallet 40, FIG. 4 illustrates the use of a clear stretch film 60 wrapped about the periphery of the stacks 59 of flower pot covers 10 and a portion of the platform 42. The stretch film 60 further serves to protect the flower pot covers 10 from dirt and water damage during the shipping and storage process. The stretch film 60 is preferably transparent to permit inspection of the flower pot covers 10 without requiring the stretch film 60 to be first removed.

In instances when greater stability may be desired, the stretch film 60 may also be wrapped over the top of the stacks of flower pot covers 10 and between the cross members 48 of the platform 42. Also, instead of using stretch film to secure the stacks of flower pot covers 10 to the pallet 40, other suitable materials for securing the stacks of flower pot covers 10 to the shipping pallet 40, by way of example, include shrink wrap, straps, and tape.

Figure 5:
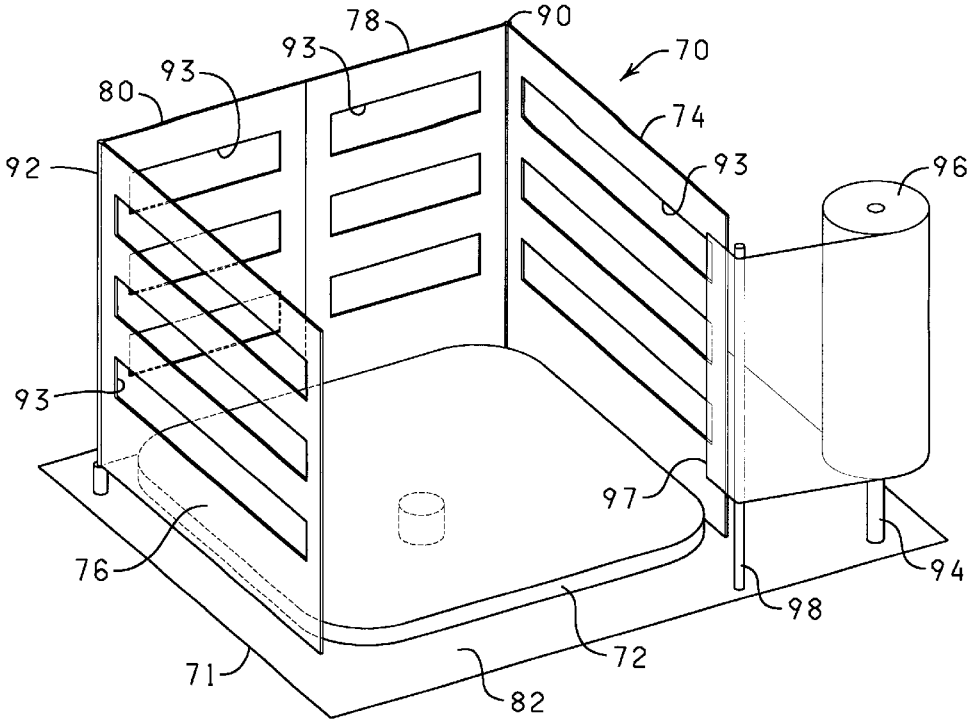
FIG. 5 is a perspective view of a stack wrapping apparatus constructed in accordance with the present invention.
Figure 6:
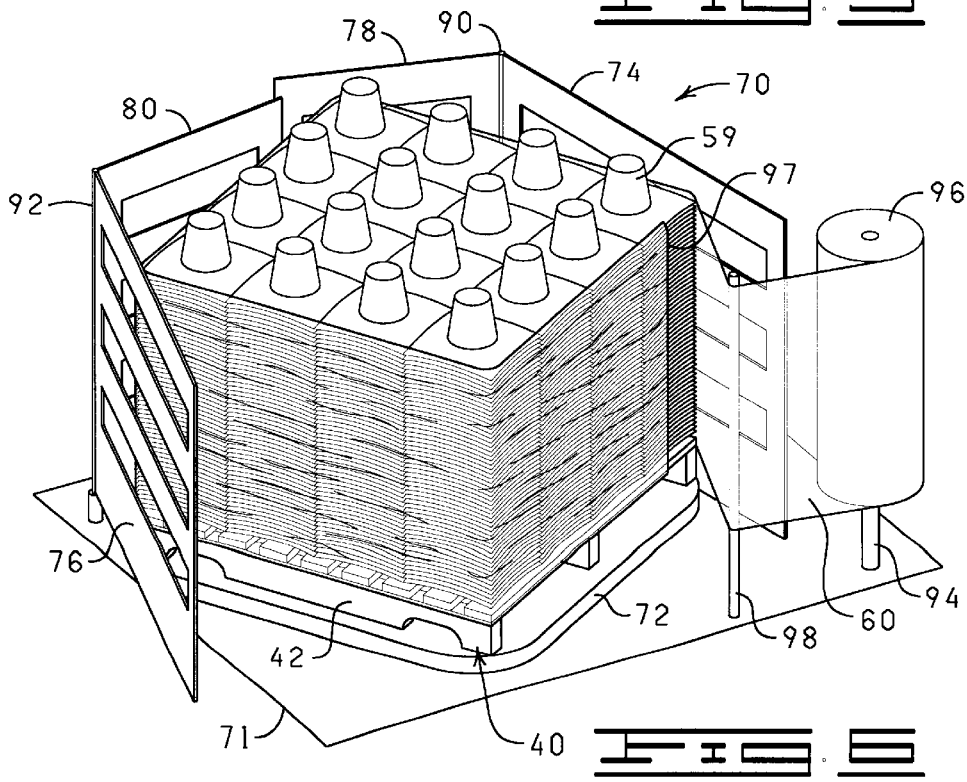
FIG. 6 is perspective view of the stack wrapping apparatus of the present invention illustrating the use thereof for wrapping a sheet of material about the stacks of preformed flower pot covers to secure same to the shipping pallet of FIG. 2.

FIGS. 5 and 6 illustrate an apparatus 70 for supporting the flower pot covers 10 on the shipping pallet 40 during the stacking process and for wrapping the stretch film 60 about the periphery of the stacked flower pot covers 10. The apparatus 70 includes a base member 71, a turntable 72 mounted to the base 71 and adapted to receive the shipping pallet 40 thereon, and a plurality of vertical support panels 74, 76, 78, 80, positioned about the turntable 72. The apparatus 70 is characterized as having an open front end 82, a first side defined by the panel 74, a second side defined by the panel 76, and a back end defined by the panel 78 and the panel 80.

The panel 74 and the panel 78 are supported in a vertical upright position adjacent to the turntable 72 by a spring hinge 90 extending upward from the base 71. The hinge 90 biases the panel 74 and the panel 78 in a perpendicular relationship relative to one another but permits the panel 74 and the panel 78 to swing outwardly away from the turntable 72 upon a force being exerted on the inner surface of the panel 74 and the panel 78.

Likewise, the panel 76 and the panel 80 are supported in a vertical upright position adjacent to the turntable 72 by a spring hinge 92 which biases the panel 76 and the panel 80 in a perpendicular relationship relative to one another but permits the panel 76 and the panel 80 to swing outwardly away from the turntable 72 upon a force being exerted on the inner surface of the panel 76 and the panel 80.

Each support panel 74, 76, 78, 80 is shown to be provided with a plurality of horizontal slots 93 for facilitating the stacking process. However, it should be appreciated that the slots 93 can be formed in the support panels 74, 76, 78, 80 in any number of orientations, such as vertically or diagonally.

The apparatus 70 further includes a rack 94 for supporting a roll of stretch wrap 96 and a guide post 98 for guiding and supporting the stretch wrap 60 removed from the roll of material 96.

In use, a shipping pallet, such as the shipping pallet 40 described above, is placed on the turntable 72 through the open front end 82 thereof. The flower pot covers 10 are then stacked onto the stacking shells of the shipping pallet 40 until the desired number of flower pot covers 10 are positioned on the shipping pallet 40. While the flower pot covers 10 are being stacked onto the pallet 40 and prior to the stack of flower pot covers 10 being secured to the shipping pallet 40 with the stretch wrap 60, the panels 74, 76, 78, and 80 serve to support the stacks of the flower pot covers 10 in a substantially vertical orientation thereby facilitating the stacking process.

To wrap the stack of flower pot covers 10 with the stretch wrap 60, a leading edge 97 of the stretch wrap 60 is fed over the guide post 98 and positioned against one of the stacks 59 of flower pot covers 10. The shipping pallet 40 with the stacks 59 of flower pot covers 10 positioned thereon is then rotated in a counterclockwise direction by rotating the turntable 72. Rotation of the shipping pallet 40 and the stacks 59 of flower pot covers 10 in turn causes the stretch wrap 60 to be wrapped around the periphery of the stacks 59 of flower pot covers 10 and an upper portion of the platform 42. The stretch wrap 60 is caused to be wrapped about the shipping pallet 40 and the stacks 59 of flower pot covers 10 one or more times so as to insure that the stretch wrap 60 secures the stacks of flower pot covers 10 to the pallet 40. Upon rotating the shipping pallet 40 and the stacks of flower pot covers 10 the desired number of rotations, a trailing end of the stretch wrap 60 is cut or torn from the roll of stretch wrap 96 and secured to an overlapping portion of the stretch wrap 60.

The spring hinges 90 and 92 bias the panels 74–80 in a position substantially parallel and adjacent the sides of the turntable 72 as illustrated in FIG. 5. The spring hinges 90 and 92 additionally permit the panels 74–80 to be swung in an outwardly direction relative to the turntable 72 to permit the turntable 72 to rotate. More specifically, to permit the panels 74–80 to support the stacks 59 of flower pot covers 10 positioned on the shipping pallet 40, which has a substantially square shape, and to accommodate the rotation of the square shaped shipping pallet 40 during the wrapping process, the panels 74–80 are caused to pivot outwardly when engaged by the corners of the turntable 72 during rotation of the turntable 72. The corners of the turntable 72 are preferably round to facilitate sliding engagement between the turntable 72 and the panels 74–80.

Figure 7:
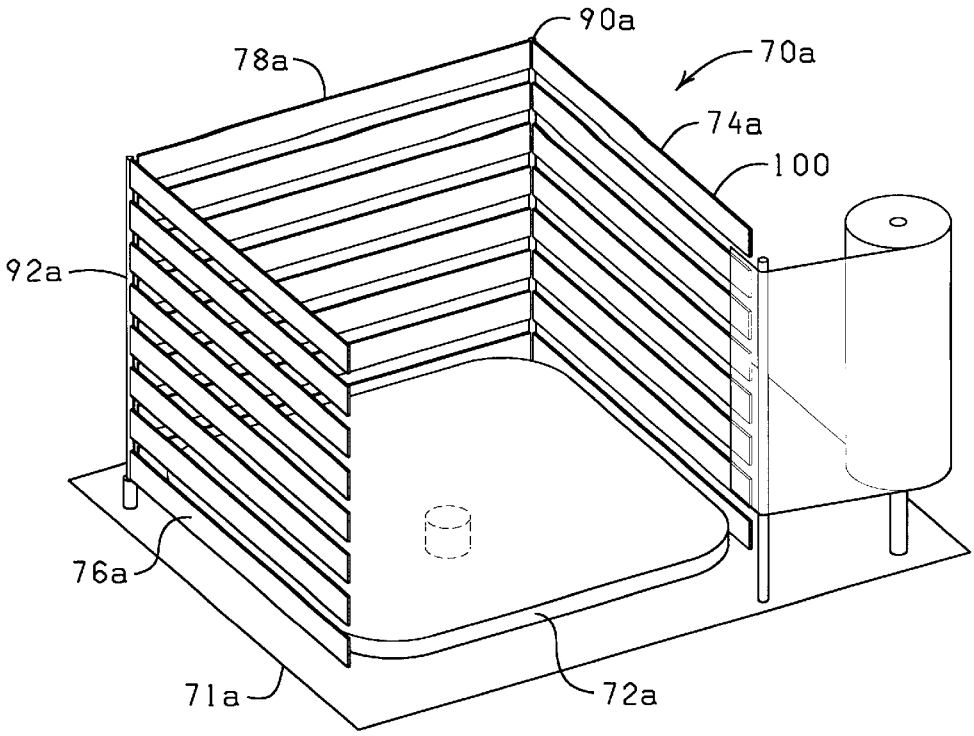
FIG. 7 is a perspective view of another embodiment of a stack wrapping apparatus constructed in accordance with the present invention.

FIG. 7 shows another embodiment of an apparatus 70*a* for supporting the flower pot covers 10 on the shipping pallet 40 during the stacking process and for wrapping the stretch wrap 60 about the periphery of the stacked flower pot covers 10. The apparatus 70*a* includes a base member 71*a*, a turntable 72*a* mounted to the base 71*a* and adapted to receive the pallet 40 thereon, and a plurality of vertical support panels 74*a*, 76*a*, 78*a* positioned about the turntable 72*a*. In contrast to the support panels 74, 76, 78, and 80 of the apparatus 70 which are rigid panels, the support panels 74*a*, 76*a*, 78*a* of the apparatus 70*a* are constructed of a plurality of semi-rigid fingers 100.

The panels 74*a* and 78*a* are supported in a vertical upright position adjacent to the turntable 72*a* by a support rod 90*a* extending upward from the base 71*a*. Likewise, the panel 76*a* is supported in a vertical upright position adjacent to the turntable 72*a* by a support rod 92*a*. The semi-rigidity of the fingers 100 permits the fingers 100 to support the stacks of flower pot covers 10 during the stacking process but permits the fingers 100 to swing outwardly away from the turntable 72*a* upon a force being exerted on the inner surface of the fingers 100. While the fingers 100 are shown to be supported in a horizontal orientation, it should be appreciated that the fingers could also be supported in a vertical orientation.

It will also be appreciated that the sides of a stacking apparatus could be separated from one another and slide horizontally away from the turntable during the rotation of the turntable.

Figure 8:
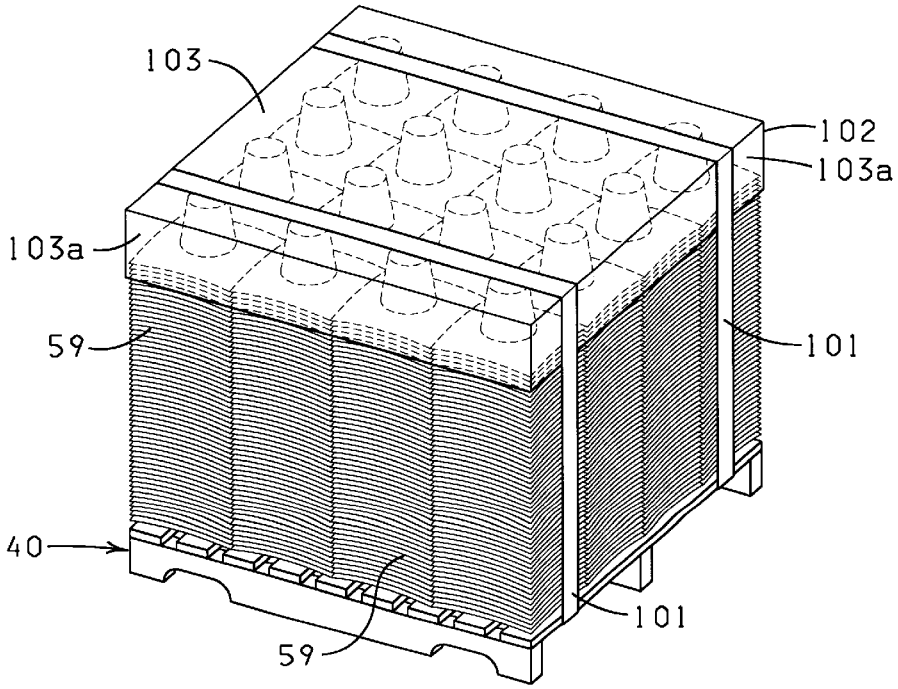
FIG. 8 is a perspective view of the shipping pallet of FIG. 2 illustrating the stacks of preformed flower pot covers being secured to the shipping pallet with a lid and a pair of straps.

Referring now to FIG. 8, the stacks 59 of flower pot covers 10 are illustrated as being secured to the shipping pallet 40 with a plurality of straps or bands 101 and a cover 102. As shown in FIG. 8, the cover 102 may be fabricated of cardboard or other suitable material and include a planar base 103 adapted to rest on the bottom end of the uppermost flower pot covers and a plurality of sidewalls 103*a* adapted to extend about a portion of the circumference of the stacks 59 of flower pot covers 10 as shown to provide stability to the stacks 59 of flower pot covers 10. The straps 101 are then positioned over the protective cover 102 and secured to the platform 42 so as to hold the stacks of flower pot covers 10 in position on the shipping pallet 40.

Figure 8A:
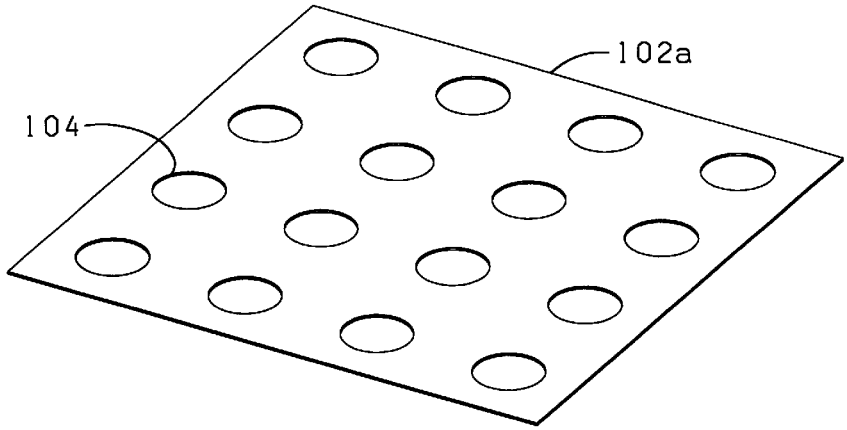
FIG. 8A is a perspective view of a cover securing member.

FIG. 8A shows another embodiment of a cover 102*a*. The cover 102*a* may be fabricated of cardboard or other suitable material and is a planar base provided with a plurality of openings 104 dimensioned to receive the uppermost flower pot covers 10 of the stacks 59 of flower pot covers 10.

Figure 8B:
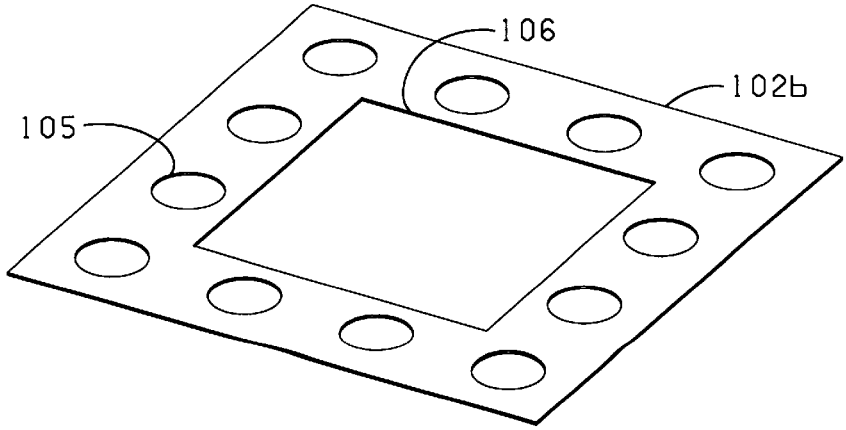
FIG. 8B is a perspective view of another cover securing member.

FIG. 8B shows an additional embodiment of a cover 102*b*. The cover 102*b* is similar to the cover 102 with the exception that the cover 102*b* is provided a plurality of openings 105 along the perimeter thereof and a central opening 106 whereby only the stacks of flower pot covers positioned on the outer perimeter will be encompassed by the cover 102*b*.

Figure 9:
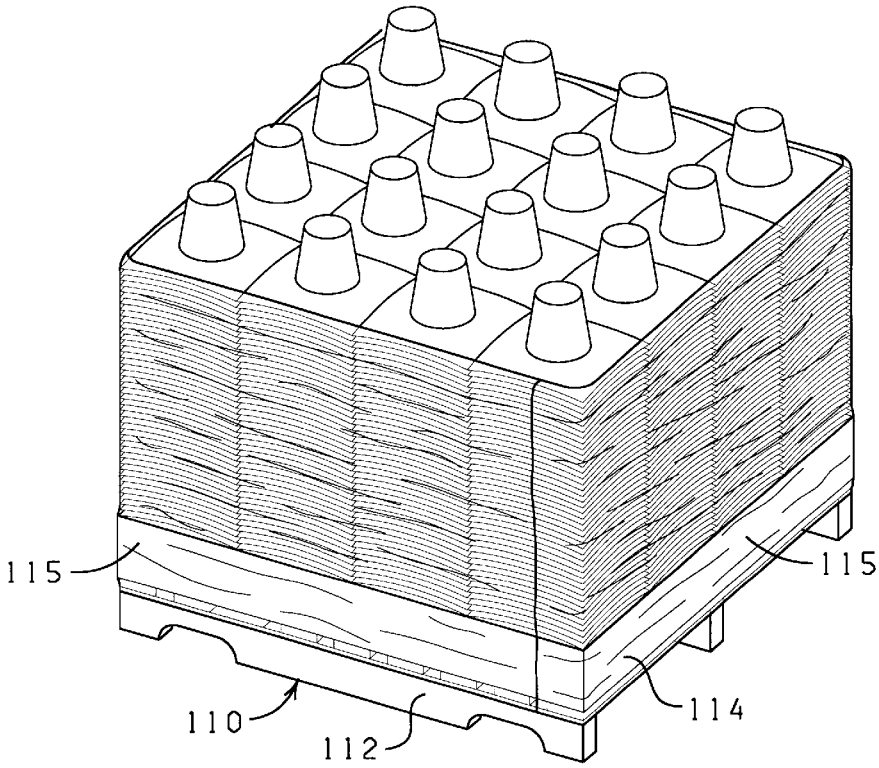
FIG. 9 is a perspective view of another embodiment of a shipping pallet in combination with a tray constructed in accordance with the present invention.

FIG. 9 shows another embodiment of a shipping pallet 110 constructed in accordance with the present invention. Like the shipping pallet 40 described above, the shipping pallet 110 comprises a portable platform 112 and a plurality of stacking shells (not shown). In addition, the shipping pallet 110 includes a container or tray 114 having a plurality of sidewalls 115 disposed on the platform 112. The stacking shells are in turn disposed on the bottom of the tray 114 whereby the sidewalls 115 of the tray 114 serve to provide additional stability to the stacks of flower pot covers.

Figure 10:
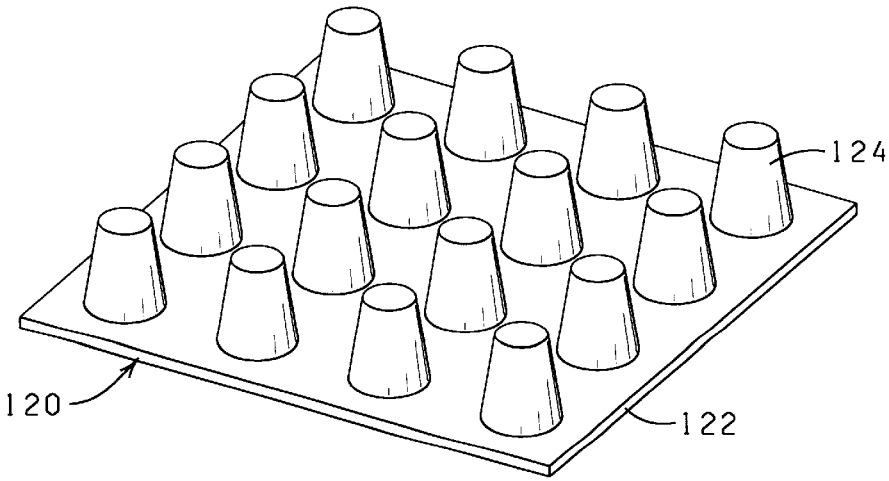
FIG. 10 is a perspective view of another embodiment of a shipping pallet constructed in accordance with the present invention.

FIG. 10 shows another embodiment of a shipping pallet 120 constructed in accordance with the present invention. Like the shipping pallet 40 described above, the shipping pallet 120 comprises a portable platform 122 and a plurality of stacking shells 124 positioned thereon. In contrast to the portable platform 42 of the shipping pallet 40, the platform 122 of the pallet 120 is in the form of a flat sheet of material commonly known as a slip sheet. Slip sheets are typically manufactured of cardboard, but can be manufactured of wood, metal, or plastic. The stacking shells 124 are merely disposed on the platform 122 or secured to the platform 122 with suitable fastening members, such as nuts and bolts, or a suitable adhesive.

It will also be appreciated that the tray 114 described above can be used in a manner similar to the platform 122. In other words, the tray 114 can be used as a portable platform with the use of the portable platform 112.

Figure 11:
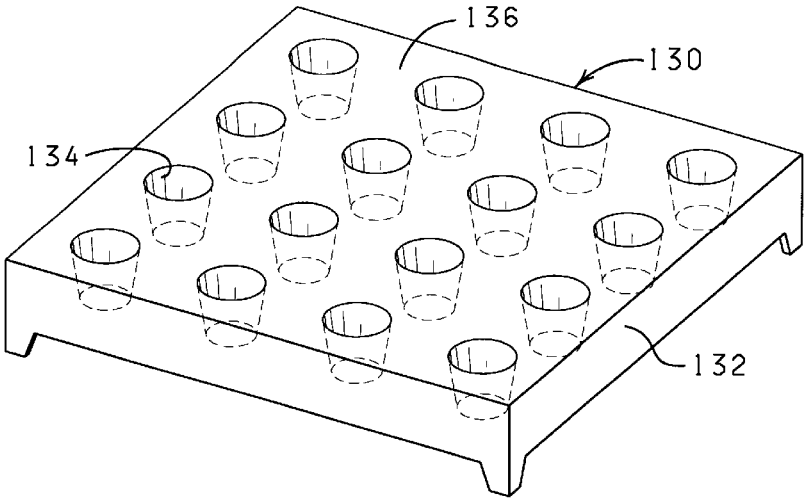
FIG. 11 is a perspective view of another embodiment of a shipping pallet constructed in accordance with the present invention.
Figure 12:
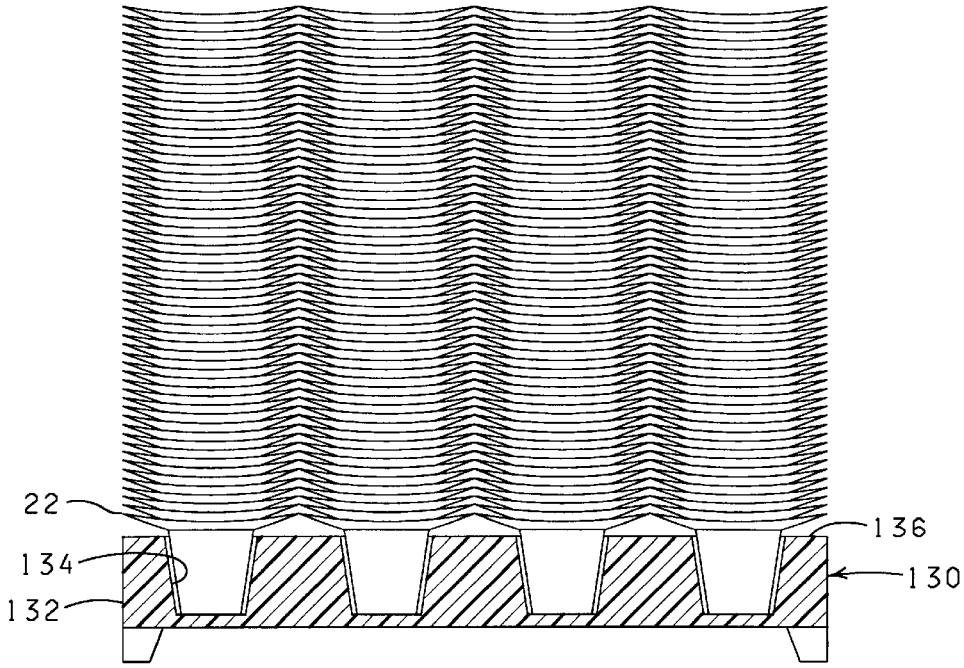
FIG. 12 is a sectional view of the shipping pallet of FIG. 11 with a plurality of stacks of preformed flower pot covers supported thereon.

FIGS. 11 and 12 illustrate yet another embodiment of a shipping pallet 130 constructed in accordance with the present invention. The pallet 130 comprises a portable platform 132 provided with a plurality of pot cover receiving recesses 134. The platform 132 is shown to be constructed of a plastic material and formed to provide an upper planar surface 136.

The pot cover receiving recesses 134 are formed in the upper planar surface 136 of the platform 132. The pot cover receiving recesses 134 are each sized and shaped to receive one of the flower pot covers 10 described above in an upright position and, in turn, support a stack of the flower pot covers 10, as illustrated in FIG. 11. The pot cover receiving recesses 134 are further sized so that the decorative skirt 22 of the bottommost flower pot cover 10 extends above the platform 132 to prevent damage to the decorative skirt 22. The stack of flower pot covers 10 supported on the shipping pallet 130 are secured to the shipping pallet 130 by wrapping a length of stretch wrap around the periphery of the stacks of flower pot covers 10 in the manner described above.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A method of shipping a plurality of preformed flower pot covers, each preformed flower pot cover including a sheet of material formed into a shape sized to receive a flower pot, the preformed flower pot cover having a base with a closed lower end and an open upper end with an object opening extending therethrough for receiving the flower pot, each preformed flower pot cover further having a decorative skirt which flairs angularly upwardly and outwardly from the upper end of the base, the method comprising:

providing a portable platform having an upper surface;

forming a plurality of stacks of preformed flower pot covers such that the preformed flower pot covers of the stacks are nested within one another;

supporting the stacks of preformed flower pot covers on the upper surface of the portable platform in an inverted position so that the decorative skirt of each of the preformed flower pot covers is in a non-load bearing condition so as to prevent damage to the decorative skirt; and transporting the platform with the stacks of preformed flower pot covers supported thereon to a predetermined destination.

2. The method of claim 1 further comprising:

securing the stacks of preformed flower pot covers to the platform.

3. The method of claim 2 wherein the securing step includes wrapping a flexible sheet of material about at least a portion of the periphery of the platform and the stacks of preformed flower pot covers.

4. The method of claim 3 wherein the sheet of material is transparent.

5. The method of claim 2 wherein the securing step comprises:

positioning a cover having a planar base on the uppermost flower pot covers of the stacks of preformed flower pot covers; and fastening the cover to the platform so as to hold the stacks of preformed flower pot covers on the platform.

6. The method of claim 5 wherein the planar base of the cover has a plurality of openings corresponding with and dimensioned to receive the uppermost flower pot covers of the stacks of preformed flower pot covers.

7. The method of claim 5 wherein the planar base of the cover has a plurality of spaced apart openings corresponding with and dimensioned to receive the uppermost flower pot covers of the stacks of preformed flower pot covers positioned along the periphery of the platform and a central opening corresponding with and dimensioned to receive the uppermost flower pot covers of the other stacks of preformed flower pot covers.

8. A method of packaging a plurality of preformed flower pot covers, each preformed flower pot cover including a sheet of material formed into a shape sized to receive a flower pot, the preformed flower pot cover having a base with a closed lower end and an open upper end with an object opening extending therethrough for receiving the flower pot, each preformed flower pot cover further having a decorative skirt which flairs angularly upwardly and outwardly from the upper end of the base, the method comprising:

providing a portable platform having an upper surface;

forming a plurality of stacks of preformed flower pot covers such that the preformed flower pot covers of the stacks are nested within one another; and supporting the stacks of preformed flower pot covers on the upper surface of the portable platform in an inverted position so that the decorative skirt of each of the preformed flower pot covers is in a non-load bearing condition so as to prevent damage to the decorative skirt.

9. The method of claim 8 further comprising:

securing the stacks of preformed flower pot covers to the platform.

10. The method of claim 9 wherein the securing step includes wrapping a flexible sheet of material about the periphery of the platform and the stacks of preformed flower pot covers.

11. The method of claim 10 wherein the sheet of material is transparent.

12. The method of claim 8 wherein the securing step comprises:

positioning a cover having a planar base on the uppermost flower pot covers of the stacks of preformed flower pot covers; and fastening the cover to the platform so as to hold the stacks of preformed flower pot covers on the platform.

13. The method of claim 12 wherein the planar base of the cover has a plurality of openings corresponding with and dimensioned to receive the uppermost flower pot covers of the stacks of preformed flower pot covers.

14. The method of claim 13 wherein the planar base of the cover has a plurality of spaced apart openings corresponding with and dimensioned to receive the uppermost flower pot covers of the stacks of preformed flower pot covers positioned along the periphery of the platform and a central opening corresponding with and dimensioned to receive the uppermost flower pot covers of the other stacks of preformed flower pot covers.

* * * * *